US009790790B2

(12) United States Patent
Laux et al.

(10) Patent No.: US 9,790,790 B2
(45) Date of Patent: Oct. 17, 2017

(54) CHISEL DEVICE AND WEAR-PROTECTED CHISEL FOR GROUND MILLING MACHINES

(71) Applicant: BOMAG GmbH, Boppard (DE)

(72) Inventors: Robert Laux, Neuwied (DE); Joachim Hermes, Viernheim (DE); Arne Schlichting, Munich (DE); Daria Hefter, Mannheim (DE); Monica Wolf, Neuwied (DE); Domenico Muscara, Muehlhausen (DE); Bernd Raufelder, Weingarten (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/503,896

(22) Filed: Oct. 1, 2014

(65) Prior Publication Data

US 2015/0091365 A1 Apr. 2, 2015

(30) Foreign Application Priority Data

Oct. 1, 2013 (DE) ..... 10 2013 016 407

(51) Int. Cl.
*E21C 35/183* (2006.01)
*E21C 35/18* (2006.01)

(52) U.S. Cl.
CPC ..... *E21C 35/183* (2013.01); *E21C 35/18* (2013.01); *E21C 2035/1803* (2013.01); *E21C 2035/1813* (2013.01); *E21C 2035/1816* (2013.01)

(58) Field of Classification Search
CPC ..... E21C 35/183; E21C 2035/1803; E21C 2035/1813; B28D 1/186; B28D 1/188
(Continued)

(56) References Cited

U.S. PATENT DOCUMENTS 3,397,012 A * 8/1968 Krekeler ..... 299/104
3,655,244 A * 4/1972 Swisher ..... 299/113
(Continued)

FOREIGN PATENT DOCUMENTS

DE 31 12 459 A1 10/1982
DE 35 19 101 A1 12/1986
(Continued)

OTHER PUBLICATIONS

Espacenet, English Machine Translation of DE3112459A1, published on Oct. 7, 1982, retrieved from http://worldwide.espacenet.com on Oct. 1, 2014 (6 pages).
(Continued)

*Primary Examiner* — David Bagnell
*Assistant Examiner* — Michael Goodwin
(74) *Attorney, Agent, or Firm* — Wood Herron & Evans LLP

(57) ABSTRACT

The present invention relates to a chisel device for a ground milling machine, comprising a chisel holder having a mounting orifice and a milling chisel, wherein the milling chisel has a basic body of, in particular, a uniform material and has a shaft and a tool region, said shaft being held, under working conditions, in the mounting orifice while the tool region (P) protrudes, under working conditions, from the chisel holder, wherein said milling chisel has a wear protection cap consisting of carbide and having a tip and a protective jacket, wherein the wear protection cap is positioned on the tool region (P) in such a manner that it covers at least 70% of the external surface of the tool region (P). The present invention also relates to a milling chisel for such a chisel device.

9 Claims, 5 Drawing Sheets

(58) Field of Classification Search
USPC ..... 299/104, 113
See application file for complete search history.

(56) References Cited

U.S. PATENT DOCUMENTS

| | | | | |
|---|---|---|---|---|
| 3,833,264 | A * | 9/1974 | Elders | E21C 35/18 175/354 |
| 4,277,106 | A | 7/1981 | Sahley | |
| 4,729,603 | A | 3/1988 | Elfgen | |
| 4,911,504 | A * | 3/1990 | Stiffler et al. | 299/113 |
| 4,944,559 | A * | 7/1990 | Sionnet et al. | 299/105 |
| 2005/0212345 | A1* | 9/2005 | Sleep et al. | 299/105 |
| 2007/0205652 | A1* | 9/2007 | Wright | B28D 1/188 299/79.1 |
| 2008/0211290 | A1* | 9/2008 | Hall et al. | 299/105 |
| 2010/0194177 | A1* | 8/2010 | Wohrstein et al. | 299/104 |
| 2010/0320003 | A1* | 12/2010 | Sollami | E21C 35/183 175/420.1 |
| 2011/0080037 | A1* | 4/2011 | Kelly | E21C 35/183 299/81.1 |
| 2011/0241409 | A1* | 10/2011 | Swope et al. | 299/111 |
| 2013/0207445 | A1* | 8/2013 | Bell | 299/105 |
| 2014/0191562 | A1* | 7/2014 | Greenspan | E02F 9/2866 299/101 |

FOREIGN PATENT DOCUMENTS

| | | |
|---|---|---|
| DE | 90 16 655 U1 | 2/1991 |
| DE | 40 39 217 A1 | 6/1992 |

OTHER PUBLICATIONS

Espacenet, English Machine Translation of DE3519101A1, published on Dec. 4, 1986, retrieved from http://worldwide.espacenet.com on Oct. 1, 2014 (6 pages).

English Translation of claim 1 of DE 35 19 101 A1, published on Dec. 4, 1986 (1 page).

Espacenet, English Machine Translation of DE9016655U1, published on Feb. 28, 1991, retrieved from http://worldwide.espacenet.com on Oct. 1, 2014 (8 pages).

English Translation of Claim 1 of DE9016655U1, published on Feb. 28, 1991 (1 page).

Espacenet, English Machine Translation of DE4039217A1, published on Jun. 11, 1992, retrieved from http://worldwide.espacenet.com on Oct. 1, 2014 (7 pages).

German Patent Office, Search Report of DE 10 2013 016 407.9, mailed Jun. 2, 2014 (7 pages).

* cited by examiner

Prior art

CHISEL DEVICE AND WEAR-PROTECTED CHISEL FOR GROUND MILLING MACHINES

CROSS-REFERENCE TO RELATED APPLICATIONS

The present application claims priority under 35 U.S.C. §119 of German Patent Application No. 10 2013 016 407.9, filed Oct. 1, 2013, the disclosure of which is hereby incorporated herein by reference in its entirety.

FIELD OF THE INVENTION

The present invention relates to a chisel device comprising a wear-protected chisel for a ground milling machine and to a chisel.

BACKGROUND OF THE INVENTION

Construction machines using such chisel devices and chisels are, in particular, ground milling machines such as road millers, recyclers, stabilizers or surface miners, often used in road construction or path construction or for the surface extraction of natural resources. They comprise a machine frame, an operator's platform, multiple crawler tracks, and a driving engine, usually a diesel engine. The key element of a ground milling machine is a milling drum, usually mounted for rotation within a milling drum box. As a rule, such a milling drum is characterized by a supporting tube in the shape of a hollow cylinder, on the cylindrical outer surface of which a plurality of milling tools is disposed. These milling tools are often designed as chisel devices, each comprising at least one chisel holder connected to the supporting tube and one milling chisel mounted in said chisel holder. During operation of the ground milling machine, the milling tools are driven into the ground by the rotation of the milling drum, thus milling off the ground material to the desired milling depth. The milled material is subsequently conveyed, for example, via a discharge conveyor, either in, or contrary to, the direction of advance, onto a transport vehicle and dispatched.

During operation, the milling chisels, in particular, are naturally subjected to a high degree of stress and, thus, to a comparatively rapid wear rate. Regular replacement is therefore necessary. To minimize the resulting costs, there is need for milling chisels having a maximum lifespan which are at the same time of a highly simple and affordable design.

A generic chisel device comprises a chisel holder and a chisel, in particular, a round-shaft chisel. The chisel holder is mounted on, for example, welded to, the cylindrical outer surface of the milling drum and the milling chisel is inserted into a mounting orifice of the chisel holder and held in position therein in such a manner that, when worn, it can be dismantled by an operator as quickly and straightforwardly as possible for replacement by a new milling chisel. Apart from single-piece variants, the chisel holder can also comprise multiple, in particular, two, sub-units, for example, one basic holder and one quick-change tool holder. In this case the basic holder is mounted on the milling drum. The quick-change tool holder is detachably fixed to the basic holder, the milling chisel being held by the quick-change tool holder. In that arrangement, both the milling chisel and the quick-change tool holder can be quickly and easily replaced in the event of wear.

A milling chisel typically comprises a basic body of, in particular, uniform material, for example, steel, and comprising a shaft and a head. The head of the milling chisel usually runs to a tip. The tip may consist of a different material, for example, carbide, and can be braze-welded to the basic body. The tip is situated, at least in part, in front of the basic body as regarded in the direction of advance of the tool. During the operation of the ground milling machine, the milling chisel engages the ground by way of the tip and mills the ground. The direction of advance of the tool is thus the direction in which the milling chisel engages the ground to be milled and is driven into the ground. To simplify, it may be stated that the direction of advance of the tool extends parallel to the longitudinal axis of the milling chisel and runs from the shaft towards the tip. In the case of a round-shaft chisel, the transverse axis coincides with the symmetry axis of the round-shaft chisel. The milled material removed from the ground glides past the chisel head and parts of the chisel holder. For the purpose of causing the wear on the chisel to be as even as possible, the chisels are often designed in such a way that they revolve about their own axis during operation. According to its function, the chisel can be divided into two regions. The tool region is that part of the chisel that protrudes from the chisel holder and comprises the head, the tip, and further devices on the milling chisel. This part of the milling chisel is in direct contact with the milled material, resulting in a great amount of stress and wear on the material, particularly in this region. In other words, the tool region defines that region of the milling chisel that protrudes from the chisel holder during operation or, more particularly, in the position in which it is inserted into the chisel holder. The second region is the shaft region or, more particularly, the holder region, substantially comprising the milling chisel shaft and surrounded by the chisel holder during operation and covered externally by the holder.

Generic chisels are disclosed, for example, in DE 31 12 459 A1. Described therein is a chisel comprising a supporting body made of steel and a chisel jacket body including a tip made of ceramic material. The ceramic material is provided to cause less sparking during the milling operation, as may be particularly relevant in mining situations in which explosive dust/air mixtures or gases are present. In the case of generic ground millers, ceramic chisels have not become established due to the fact that their manufacturing costs are significantly higher than those of carbides. In addition, milling chisels having carbide tips are disclosed, for example, in DE 40 39 217 A1. In addition to the tip, a wear-proof layer is applied to the chisel head to prevent fracture of the head. Neither does this solution, however, result in a satisfactory lifetime of the milling chisels.

It has been found that many chisels suffer wear due not to wear of the carbide tip but to wear of the steel chisel head, necessitating replacement thereof. The milled material moving past the head results in a continuous loss of material at the chisel head to possibly such an extent that the carbide tip, although still fully functional, loses its hold on the chisel head. In other words, the holding material for the tip is eroded during operation. This means that the comparatively expensive carbide tip cannot be used over its entire life and that, instead, an early replacement of the entire chisel becomes necessary despite the fact that the lifespan of the tip has by no means been exhausted. Furthermore, at the same time damage to the chisel holder may often occur due to such breakage, resulting in the chisel holder also having to be replaced, which increases the costs still further. Furthermore, the prior art tips cannot be glued to the milling chisels, due to the occurring shearing loads, but must be soldered to the relevant supporting parts of the milling chisel. Soldering leads to an influx of heat into the material, which changes the structure of the basic body. For the purpose of obtaining a stable end product, such changes must be compensated for after soldering by way of further heat treatment, which further complicates the production and increases the production costs.

It is thus an object of the present invention to provide a chisel device for a ground milling machine and a milling chisel for said chisel device that can be produced at low cost and that are characterized by an increased lifetime. In particular, it is desired to prevent break-off of a still functional carbide tip in the chisel head region.

SUMMARY OF THE INVENTION

This object is achieved by means of a generic chisel device for a ground milling machine. Essential elements of the chisel device are the chisel holder comprising a mounting orifice, and a milling chisel. The milling chisel comprises a basic body of, in particular, uniform material, substantially divided into a shaft region, more particularly, a holding region, and a tool region. During operation of the ground milling machine or, more particularly, of the chisel device, the shaft is located in the mounting orifice of the chisel holder with the tool region protruding therefrom. The shaft region, more particularly, the holding region, of the milling chisel, when installed, is thus held by the chisel holder and shielded from the outside. By contrast, the tool region of the basic body and of the entire milling chisel is that region that protrudes from the chisel holder when inserted in the chisel holder. The milling chisel further comprises a carbide wear protection cap comprising a tip and a protective jacket. The tip of the wear protection cap constitutes a region which is pointed, for example, cone-shaped, as regarded in the direction of advance of the tool, whereas the entire protective jacket is designed for the provision of at least partial sheathing of the tool region in a radial direction relative to the longitudinal axis of the chisel. According to one embodiment of the present invention, the wear protection cap is designed such that it covers at least 70% of the outer surface of the tool region when in position on the tool region. This allows for particularly efficient protection of the basic body of the chisel against abrasion. Thus, the periods of operation can be significantly lengthened and the entire wear potential of the carbide caps can be utilized. Additionally, the milling chisel is of a comparatively simple design, ideally consisting of merely two components, with the result that production costs are also comparatively low.

The term "of uniform material" in this case means that the basic body of the chisel essentially consists of one material only, for example, steel. Furthermore, the basic body is ideally composed of a single solid piece. Having been mounted on the tool region of the milling chisel, the wear protection cap is disposed at the front as considered in the direction of advance of the tool and serves the purpose of wear protection of the milling chisel, particularly of the head of the milling chisel and, more particularly, of the basic body. "Wear protection" does not mean that wear is entirely obviated. This is not possible, due to the enormous stress imposed during the milling operation. The wear protection is merely aimed at slowing down the progress of the wear on the milling chisel and, most particularly, on that part of the basic body that is covered by the wear protection cap. The carbide wear protection cap is itself, during the process, also subjected to wear. It thus serves two purposes at the same time. Firstly, it serves as a working part of the milling chisel and cuts or, more specifically, mills the ground directly, and secondly, it protects that part of the milling chisel covered by it from the direct influence of the milled material and, thus, reduces the wear caused thereby. Particularly long lifespans are achieved when the wear protection cap is designed such that the surface of the milling chisel covered thereby is large enough to retard wear and to thus surely prevent occurring loss of material of the basic body of the chisel to cause the tip to break away from the basic body during operation prior to the end of the tip's lifespan, or to at least prevent the necessity of an early replacement of the milling chisel long before this is justified by the amount of wear on the carbide tip. A further advantage of the wear protection cap is the fact that the shearing forces acting thereon are transmitted to the core in an advantageous manner such that the wear protection cap can be glued to the core of the chisel, thus allowing for a more cost-effective production as compared with braze welding and the associated heat treatment.

For the purpose of minimizing wear it is preferable for the wear protection cap of the milling chisel to be designed in such a way that it covers the outer surface of the tool region of the basic body to an extent of at least 80%, preferably at least 90%, and, more preferably, substantially completely when mounted on the tool region of the basic body. The greater the extent of coverage of the outer surface of the tool region of the basic body of the milling chisel, the greater is the degree of retardation or, more particularly, of prevention of wear on the chisel head of the basic body such that the maximum lifetime of the wear protection cap can be utilized to its full extent. "Substantially completely" in this case means that the wear protection cap covers either 100% of the outer surface of the tool region of the basic body or that the wear protection cap covers the tool region of the basic body except for a small proportion thereof directly adjacent to the region in which the milling chisel, in particular, the basic body, engages with the chisel holder. In the event of a small proportion of the tool region not being covered by the wear protection cap, it is preferable for said part to be radially inwardly offset relatively to the wear protection cap transversely to the direction of advance of the tool and, thus, to be positioned so-to-say in the slipstream of the wear protection cap. The relevant outer surface in this regard defines the outer surface of the tool region of the basic body projecting, or protruding, from the mounting orifice of the basic body when installed therein.

Apart from a full-surface design of the wear protection cap it has been shown that effective wear protection can also be achieved when the wear protection cap of the milling chisel comprises webs, as regarded in the direction of the peripheral region, that face away from the tip and are spaced at a distance from one another by means of recesses extending in the direction of advance of the tool. The webs thus extend from the wear protection cap in the direction of advance of the tool towards the rear in the direction of the chisel shaft. The radial or finger-like webs are spaced at a distance from one another and define the recesses extending between them. The portions of the milling chisels in the tool region situated below the webs are protected from wear in the manner described above. The regions of the milling chisel situated between the webs below the recesses are, however, subjected to the milled material and wear faster than the regions below the webs. Even so, the webs provide a certain protective function for said regions due to the fact, for example, that large pieces of milled material are incapable of passing between the webs. Such an effect increases during the lifespan of the milling chisel due to partial wear of the milling chisel between the webs, resulting in milled material having to enter the cavities thus created between the webs at increasingly deeper levels for the purpose of removing further material from the milling chisel. Compared with the full-surface embodiment, the formation of webs on the wear protection cap allows for a more economical use of carbide, thus reducing production costs.

The wear protection cap of the milling chisel preferably has profiles and/or incisions on its outer surface, particularly, for the purpose of creating or increasing a state of elasticity of the wear protection cap. This can be effected, for example, by provision of mounds, or troughs, openings, channels, or incisions forming a distinct pattern on the wear protection cap. Conceivable are, for example, linear, serpentine, or, more particularly, wavy, zig-zag, or spiral profiles and/or incisions. Rotation of the milling chisel during operation may significantly contribute to achieving even wear of the milling chisel. Depending on the elasticity of the material of the wear protection cap, slotted recesses can, in particular, serve for additionally or alternatively fixing the wear protection cap to the milling chisel in the manner of a snap fastener. In this way the wear protection cap can, for example, be slightly stretched when attached to the basic body and, thus, clamp itself onto the basic body. Alternatively, a combination of clamping, gluing, welding, soldering, etc., can of course be used for the purpose of attaching the wear protection cap.

One embodiment of the profile comprises a plurality of slots which extend in an at least partially spiral pattern from the tip of the wear protection cap to the peripheral region of the protective jacket facing away from the tip. An elevated region, which is, in particular, implemented as a web or a ridge, is arranged in direct adjacency of the slots. Paralleling the slots, the elevated region likewise extends in an at least partially spiral pattern from the tip of the wear protection cap to the peripheral region of the protective jacket facing away from the tip. The elevated region can, for example, be a rounded and elongate projection and, in particular, forms a single piece together with the wear protection cap. The distance of protrusion of the elevated region/projection from the wear protection cap, for example, corresponds to the thickness of the wear protection cap. However, a greater or smaller size of the elevated region is conceivable as well. The elevated region and the slot are arranged in such a manner that when the milling chisel is in rotation during working operation the elevated region is located in advance of the slot as regarded in the direction of rotation. With respect to the direction of rotation, the slot is thus located, so to speak, in the slipstream of the elevated region during working operation. Due to this combination of elevated regions and slots running around the wear protection cap in an at least partially spiral pattern, milled material can be kept away from the slots of the rotating milling chisel during working operation. Gliding along the protective jacket of the wear protection cap, the milled material hits the elevated region and is guided away from the protective jacket of the wear protection cap, as a result of which less milled material enters the slots of the wear protection cap.

Generic milling chisels often feature a contact ledge in the head region or, more particularly, in the tool region for the purpose of attaching the milling chisel to the chisel holder. Such a contact ledge thus represents the dividing line between the tool region and the shaft, which is concealed by the chisel holder due to the fact that it is inserted in the mounting orifice of the chisel holder. The greatest amount of abrasive stress caused by milled material is borne by that region of the milling chisel that is situated in front of the contact ledge as regarded in the direction of advance of the tool. This region is particularly well protected against wear when the wear protection cap of the milling chisel is provided with a collar and when it ends with such a collar in front of the contact ledge as regarded in the direction of advance of the tool or when it ends flush with said contact ledge. In this case, "flush" means that the collar of the wear protection cap is also in contact with the chisel holder. In this way, the wear protection cap extends over a large proportion of the tool region as regarded contrary to the direction of advance of the tool as far as the contact ledge for the chisel holder.

For the purpose of preventing or decelerating wear in the tool region of the milling chisel for as long as possible, it is advantageous when the wear protection cap of the milling chisel features a greater wall thickness in regions suffering more stress during operation than in regions that suffer less stress during operation. In that way, the different regions of the protective jacket can be provided with varying degrees of wall thickness depending on the amount of stress expected. Thickening of the protective jacket is particularly advantageous in the region surrounding the tip of the wear protection cap, as well as on the tip itself. Hence, the wear protection cap of the milling chisel should comprise a tip having a larger wall thickness than the protective jacket. The tip is the region of the wear protection cap that suffers the greatest amount of stress due to it being driven directly into the ground during the cutting and milling operation. The thickness of material of the tip should therefore be increased beyond that of the rest of the wear protection cap, in particular, that of the protective jacket. The greater thickness results in a greater lifespan of the wear protection cap and, thus, of the milling chisel. The wall thickness is defined as the shortest distance between the outer surface of the wear protection cap and the opposing inner surface of the wear protection cap at the relevant point of measurement.

Production costs and material properties on the one hand and the associated lifespan of the milling chisel on the other are particularly well balanced when the wear protection cap of the milling chisel consists exclusively of carbide. Carbides in this case are sintered composite materials made of one or more reinforcing phases (for example, tungsten carbide) and a binding agent (for example, cobalt, nickel, and/or iron) and are characterized by a very high degree of hardness, heat hardness, and wear resistance. The term "exclusively" in this context means that the wear protection cap itself consists entirely of carbide, in particular, throughout. This does of course also include embodiments that feature a further layer, in particular, a fixing layer, for example, a soldering, welding, and/or gluing layer between the wear protection cap and the basic body of the milling chisel.

It is basically preferred for the wear protection cap to be made of uniform material and is, in particular, solid or, in other words, consists of a single layer. It is, however, also conceivable for the wear protection cap of the milling chisel to feature multiple jacket layers. The different layers may consist of the same material or of different materials. It is thus conceivable, for example, for the upper or outer layer, that is to say the layer first coming into contact with the ground or the milled material, to consist of a material that is harder than one or more of the layers lying beneath it. An embodiment of the wear protection cap consisting of multiple layers of different materials results in the combination of positive material characteristics of the different layers. One of the lower layers can, for example, have elastic properties, which results in a particularly advantageous wear performance during interaction with an outermost layer having maximum hardness properties.

For the purpose of achieving a wear protection cap of the milling chisel that is as solid as possible and that withstands the stresses occurring during the milling operation, said wear protection cap may be designed as one piece. In the present embodiment, the tip and the protective jacket are thus in the form of a single one-piece component. The terms "tip" and "protective jacket" thus signify regions on one and the same component. In this respect the wear protection cap is preferably formed as one piece and is also composed, more particularly, of uniform material.

However, the wear protection cap of the milling chisel may alternatively comprise a number of pieces. For example, the wear protection cap of the milling chisel may comprise wear protection rings or, more particularly, wear protection sleeves, set in both cases at a distance from each other. Said rings extend, for example, radially around the tool region of the milling chisel with reference to the longitudinal axis of the milling chisel. At the same time said rings can be set axially at a distance from each other with reference to the longitudinal axis of the milling chisel.

Furthermore, in the case of multi-piece embodiments of the wear protection cap, provision may preferably be made for the wear protection rings of the milling chisel to interlock in such a manner that each wear protection ring is overlapped by the wear protection ring lying ahead as regarded in the direction of advance of the tool or in the axial direction of the longitudinal axis of the milling chisel. Such an overlap surely prevents a wear protection ring from slipping forwardly off the milling chisel in the direction of advance of the tool. The wear protection ring can only slip forward up to the point where its overlapped edge has slipped beneath the ring positioned in advance thereof as regarded in the direction of advance of the tool and bears against the same. Such a system is particularly efficient when the wear protection rings of the wear protection cap of the milling chisel engage in a form-fitting manner. A form-fitting engagement furthermore guarantees faultless functioning during operation.

The wear protection cap may be provided with predetermined breaking points. By the term "predetermined breaking points" are meant regions of the wear protection cap that are particularly thin or, in particular, linear regions that have been made fragile by the provision of, for example, drill holes. Under pressure, a fracture will occur substantially precisely along said predetermined breaking point, thereby achieving an efficient dissipation of force, particularly, for protection of the basic body. The predetermined breaking points are designed to break a wear protection cap made as a single-piece component into a multi-piece component. In the event of overloading, a wear protection cap originally made as a single piece comprising predetermined breaking points will thus break up to form a multi-piece wear protection cap. Breakage at the predetermined breaking points can, however, already occur during production or during operation due to the stress caused by the milled material. It is possible, for example, that during operation the wear protection cap of the milling chisel will break up to form the wear protection rings at the predetermined breaking points. In this case, the predetermined breaking points run along circles around the wear protection cap, each circle being on a plane disposed transversely to the direction of advance of the tool. The stress applied during operation causes breakage along said circles, as a result of which the single-piece wear protection cap is separated so as to produce the multi-piece form comprising wear protection rings, ideally, however, in such a way that the wear protection cap remains on the basic body of the milling chisel.

The object of the present invention is further achieved by means of a milling chisel for a chisel device. In this case reference is made to the above embodiments with respect to the design of the chisel device and, more particularly, of the milling chisel. All characteristics concerning the design of the milling chisel of the chisel device according to the present invention relate to and, thus, disclose the design according to the present invention of the milling chisel and are not specifically mentioned again here purely to avoid repetition.

The present invention is explained in detail below with reference to exemplary embodiments shown in the figures, in which:

BRIEF DESCRIPTION OF THE DRAWINGS

Like or functionally identical components are identified in the figures by the same reference numerals. Repeated components are not individually denoted in every figure.

DETAILED DESCRIPTION OF THE INVENTION

Figure 1:
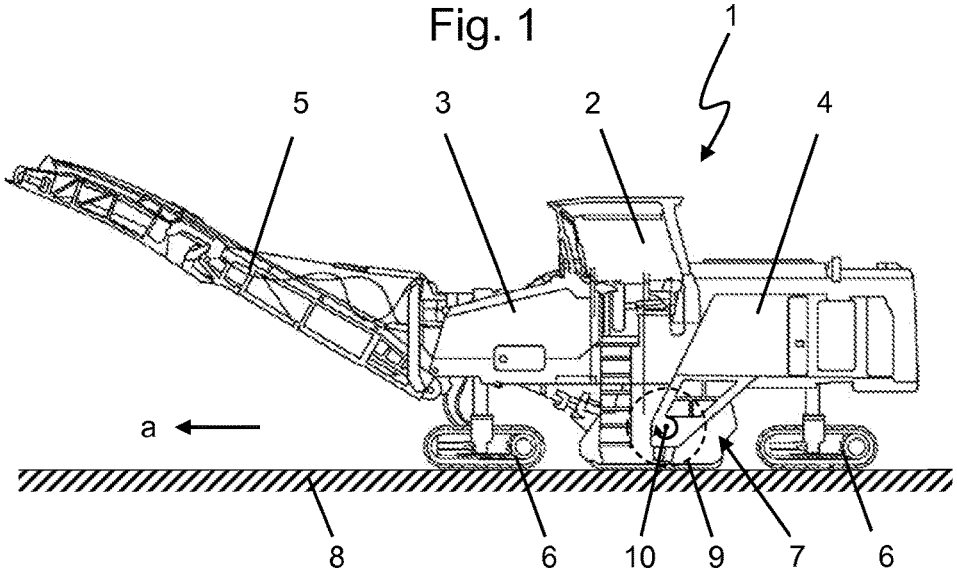
FIG. 1 is a side view of a generic ground milling machine.

FIG. 1 illustrates a generic ground milling machine 1, in this case a road miller or, more particularly, a cold miller of the central drum type in which the chisel devices described in more detail below are used. Said ground milling machine comprises an operator's platform 2, a machine frame 3, a driving engine 4, and crawler tracks 6. During operation of the ground milling machine 1 the ground 8 is depleted in the direction of advance a by means of a milling drum 9 rotatably mounted about the axis of rotation 10 within the milling drum box 7. The milled material is dispatched via the discharge conveyor 5.

Figure 2:
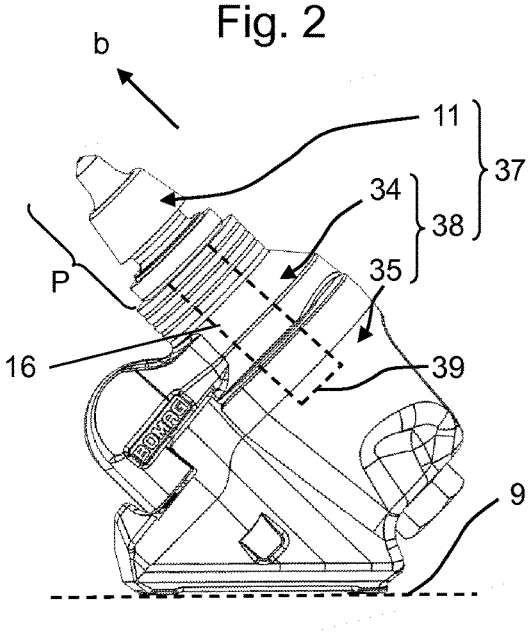
FIG. 2 is a side view of a generic chisel device.
Figure 3:
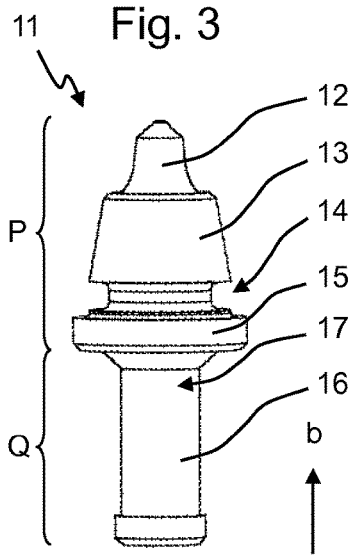
FIG. 3 is a side view of a generic milling chisel.

A plurality of chisel devices 37 is mounted on the hollow cylindrical supporting tube of the milling drum 9, one of which is shown by way of example in FIG. 2. The chisel devices 37 comprise a chisel holder 38 and a milling chisel 11 held in the mounting orifice 39 by means of its shaft 16 (FIG. 3; indicated by dashed lines in FIG. 2). The tool region P protrudes from the chisel holder 38. The tool region is driven into the ground 8, for the sake of simplicity in the direction of advance b of the tool, by way of rotation of the milling drum 9 about the axis of rotation 10 during operation of the ground milling machine 1 for the purpose of milling the ground. The chisel holder 38 is, in the present example, composed of a quick-change tool holder 34 and a basic holder 35, the quick-change tool holder 34, being attached to the basic holder 35, which is in turn fixed to the milling drum 9.

FIG. 3 shows in detail a milling chisel 11 of the prior art. The milling chisel 11 is divided into a tool region P disposed at the front as regarded in the direction of advance b of the tool, and into a holder region Q disposed at the rear as regarded in the direction of advance b of the tool. During operation of the ground milling machine 1, the tool region P makes direct contact with the milled material whilst the holder region Q is in the mounted condition exclusively disposed within the mounting orifice 39 and hence concealed from external view by the chisel holder 38. The milling chisel 11 furthermore comprises a carbide tip 12 soldered to the basic body 17 of the milling chisel 11. The carbide tip 12 is connected to a sleeve 13 surrounding the basic body 17 of the milling chisel 11. An indentation 14 and a wear plate 15 enabling contact between the milling chisel 11 and the chisel holder 38 connect further towards the rear as regarded in the direction of advance b of the tool. In the case of this prior art embodiment, so-called "erosion" of the sleeve and subsequently of the basic body 17 in the tool region P frequently occurs. A consequence of this is a break-off of the carbide tip 12 prior to the end of its lifespan, and an exchange of the milling chisel 11 and, thus, wastage of the remaining lifespan of the carbide tip 12 are inevitable.

Figure 4:
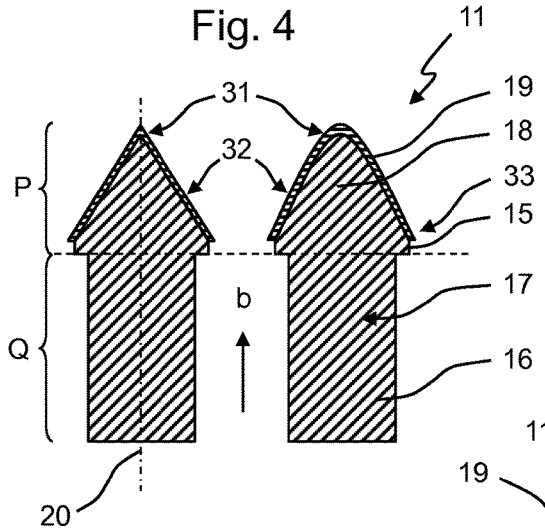
FIG. 4 shows two cross-sectional views of milling chisels according to a first embodiment.
Figure 5:
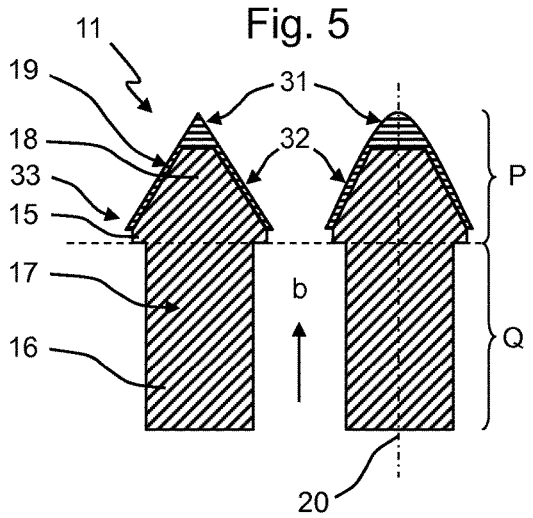
FIG. 5 shows two cross-sectional views of milling chisels according to a second embodiment.
Figure 6:
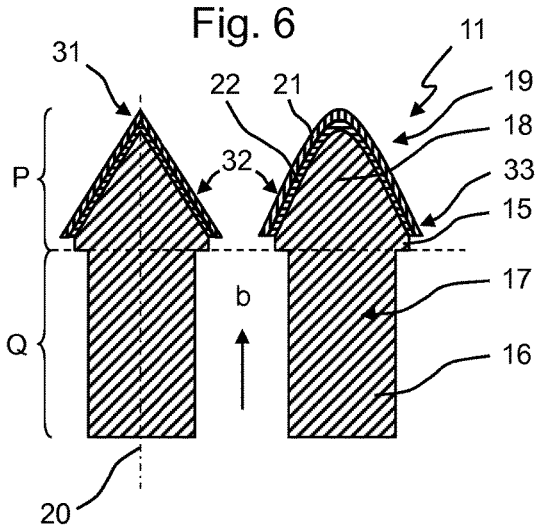
FIG. 6 shows two cross-sectional views of milling chisels according to a third embodiment.

FIGS. 4, 5, and 6 show cross-sectional views of milling chisels 11 according to one embodiment of the present invention comprising wear protection caps 19. In each case the cross-sectional view runs along the longitudinal axis 20. The wear protection caps 19 are attached to the head 18 of the milling chisel 11 in the tool region P and are fixed thereto, for example, by braze welding, clipping, gluing, or welding. The milling chisels 11, in particular, inclusive of the wear protection caps 19, can be arranged rotationally symmetrically about the symmetry axis 20. In the case of a non-rotationally symmetrical design, the reference numeral 20 defines the longitudinal axis of the milling chisel 11.

The wear protection caps 19 are uniformly made of carbide and comprise a tip 31 and a protective jacket 32 extending radially about the symmetry axis 20 contrary to the tool direction b. The tip 31 of the milling chisel 11 can be either tapered or rounded. The wear protection cap 19 comprises, and ends at, a collar 33 and extends across the major part of the tool region P up to a point situated just before the contact ledge 15 and, thus, protects the basic body 17, in particular, the head 18, of the milling chisel 11 from wear caused by the milling operation. It is essential in this case that the wear protection cap is basically formed such that it conceals only the area of the tool region P and does thus not extend beyond the shaft or the holder region Q.

Figure 7:
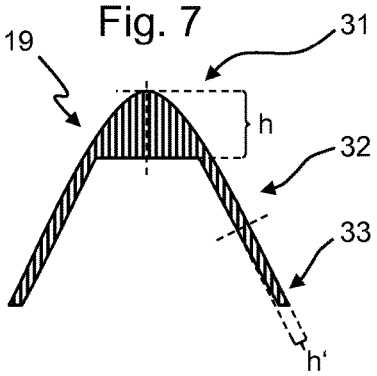
FIG. 7 is a cross-sectional view of a wear protection cap shown in FIG. 5.

The exemplary embodiments shown in FIG. 4 show wear protection caps 19 having a uniform wall thickness h. FIG. 7 illustrates the manner in which the wall thickness h is determined. The wall thickness h describes the shortest distance between the outer surface of the wear protection cap 19 and the inner surface of the wear protection cap 19 at a respective measuring point. The wear protection cap 19 shown in FIG. 7 thus has a wall thickness h at the tip 31 and a wall thickness h' at the protective jacket 32. In this respect the wall thickness h is always typically determined at right angles to the outer surface of the wear protection cap 19. The wear protection caps 19 in FIG. 4 are therefore consistently of the same thickness. Differences in the two exemplary embodiments shown in FIG. 4 thus reside in the individual geometrical designs of the tool region P. On the left-hand side, this is in the form of a pointed cone having straight sides and on the right-hand side in the form of a rounded cone having elliptically curved sides. The two design variants are, however, equivalent to each other in their basic construction, so that the reference numerals referring to the right-hand exemplary embodiment also apply to the left-hand embodiment.

FIG. 5 shows two alternative embodiments. The essential difference from the exemplary embodiments of FIG. 4 lies in the fact that the tip 31 of the wear protection cap 19 has a greater wall thickness h than the protective jacket 32. Such thickening of the wear protection cap 19 refers to a region of the tip 31 that extends contrary to the direction of advance b of the tool from the foremost point of the milling chisel 11 as regarded in the direction of advance b of the tool. The wall thickness h of the wear protection cap 19 increases in this region in the direction of advance b of the tool up to the point of intersection of the longitudinal axis 20. The sleeve region 32, however, has a consistent wall thickness. In general, there is obtained a solid tip 31 made of carbide that withstands maximum stress during milling and that shows greater resistance to said stress due to its increased wall thickness h. Said tip thus contributes to extension of the lifetime of the milling chisel 11. At the same time, the core 17 is effectively protected at its sides in the tool region P against the flow of milled material by means of the protective jacket 32. For the purpose of accommodating for said thickened region of the wear protection cap 19, the core 17 has a plateau-like flattened tip region. The reference numerals used for the left-hand embodiment also apply to the right-hand embodiment.

FIG. 6 shows two exemplary embodiments of the milling chisel 11 of the present invention having wear protection caps 19 consisting of multiple jacket layers 21, 22. The jacket layers 21, 22 may each consist of the same material, for example, a carbide, or of two different carbides. It is, however, also possible, for example, to form the outer jacket layer 21 of carbide and the secondary jacket layer 22 of a softer, preferably flexible, material for the purpose of combining their positive material properties. The jacket layers 21, 22 can also be joined together by means of clips or by soldering, welding, or gluing. Again, the differences between the two embodiments reside in the pointed-cone shape (on the left) and the rounded-cone shape (on the right) of the tip region of the milling chisel 11. Here again, the reference numerals of the right-hand exemplary embodiment equally apply to the left-hand exemplary embodiment.

The FIGS. 8, 9, 10, and 11 illustrate further details of the embodiment of the wear protection cap 19.

Figure 8:
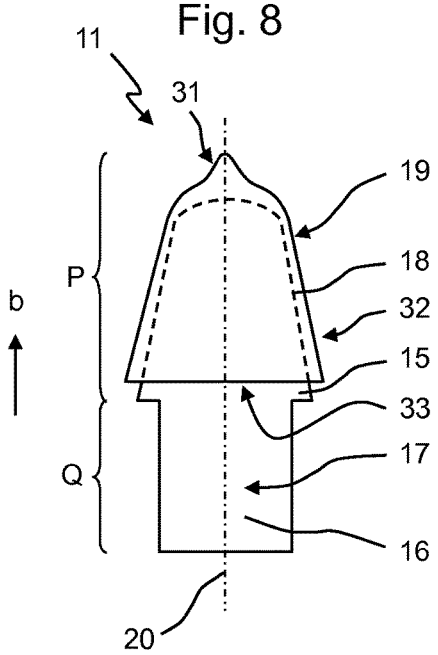
FIG. 8 is a side view of a milling chisel according to a closed embodiment.

The embodiment in FIG. 8 features a wear protection cap 19 of an uninterrupted single-piece of solid design including a thickened tip 31. Its protective jacket 32 extends to the collar 33 to a point just anterior of the contact ledge 15. The tool region P is concealed almost entirely by the wear protection cap 19 and protected from wear. That part of the head 18 of the basic body 17 of the milling chisel 11 that forms the contact ledge 15 is radially inwardly offset as regarded from the direction of the symmetry axis 20. The contact ledge 15 and that part of the head 18 that forms it lie in the slipstream of the wear protection cap 19 as regarded in the direction of advance b of the tool, said contact ledge being therefore also protected from excessive wear caused by the milled material.

Figure 9:
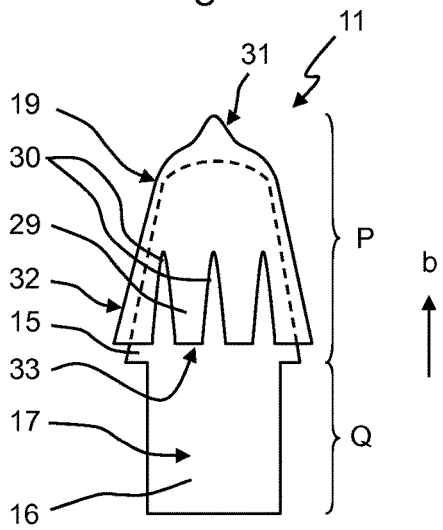
FIG. 9 is a side view of a milling chisel according to an embodiment comprising webs.

The embodiment of the wear protection cap 19 shown in FIG. 9 embodies a number of finger-shaped or tongue-shaped webs 29 extending in the direction of advance b of the tool and protruding from the wear protection cap 19 contrary to the direction of advance b of the tool. An amount of material of the wear protection cap 19 is missing between the webs 29, such that the webs 29 are separated from each other by means of recesses 30. Nonetheless, the webs 29 also provide protection for the regions of the head 18 of the milling chisel 11 lying beneath the recesses 30 during operation. The milled material is guided along the head 18 of the milling chisel 11 by means of the uninterrupted part of the wear protection cap 19 situated toward the front as regarded in the direction of advance b of the tool and the webs 29 in such a manner that the wear on the head 18 progresses only marginally faster in the regions of the recesses 30 than in the regions lying beneath the webs 29. In return, material is saved due to the recesses 30, which on the whole reduces the production costs of the wear protection cap 19.

Figure 10:
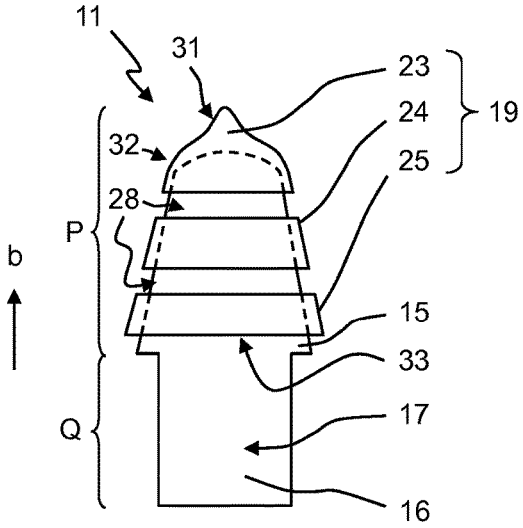
FIG. 10 is a side view of a milling chisel according to a multi-piece embodiment.

The embodiment shown in FIG. 10 also requires less material and can thus be produced in an inexpensive manner. In this case the wear protection cap 19 is of a multi-piece design and comprises three wear protection rings 23, 24, and 25 set at a distance from one another. A greater or smaller number of wear protection rings may of course be used if desired. The wear protection ring 23 is attached to the milling chisel 11 as described above in the case of the single-piece wear protection caps 19. The wear protection rings 24 and 25 positioned further towards the rear of the tool region P as regarded in the direction of advance b of the tool can either be fixed thereto or lie loosely thereon. In the latter case they are made in such a manner that slippage thereof from the milling chisel 11 in the direction of advance b of the tool is impossible. This is ensured, for example, by the fact that the inner diameter of the wear protection ring 24, 25 positioned further towards the rear in the direction of advance b of the tool is smaller than the outside diameter of the wear protection ring 23, 24 respectively positioned further towards the front as regarded in the direction of advance b of the tool. Additionally, the production of the wear protection cap 19 in FIG. 10 can be simplified by being manufactured as a single-piece component despite its multi-piece design. In this case, the wear protection rings 23, 24, 25 are attached to each other at the time of production. Predetermined breaking points 28 are provided between them, allowing for precise separation of the wear protection rings 23, 24, 25 either during production or, particularly, in the case of the wear protection rings 24, 25 lying loosely on the milling chisel 11, during operation due to the stresses caused by the milled material. As described above with respect to the webs 29, the wear protection rings 23, 24, 25 also protect the regions of the head 18 of the milling chisel 11 lying therebetween and not covered thereby, by means of advantageous guidance of the milled material.

Figure 11:
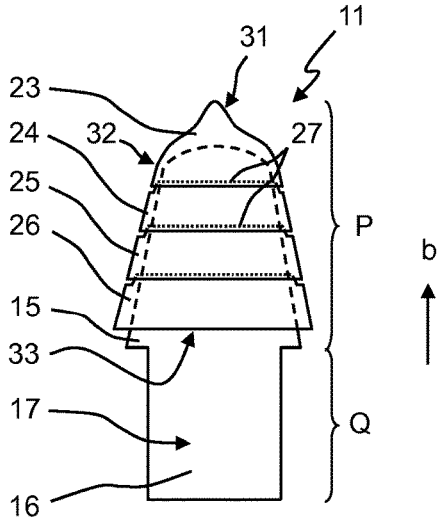
FIG. 11 is a side view of a milling chisel according to a multi-piece overlap-type embodiment.
Figure 12:
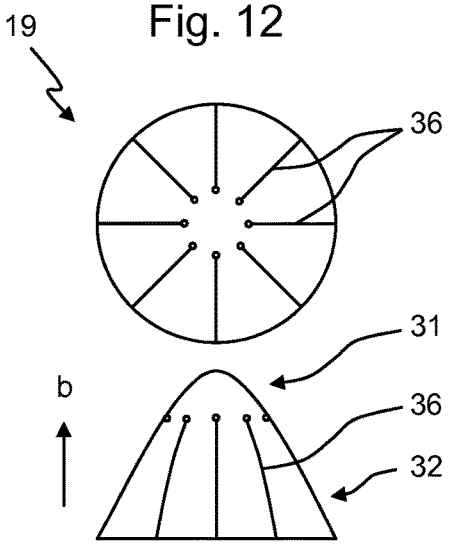
FIG. 12 shows a side view and a front view of a wear protection cap comprising linear profiling.
Figure 13:
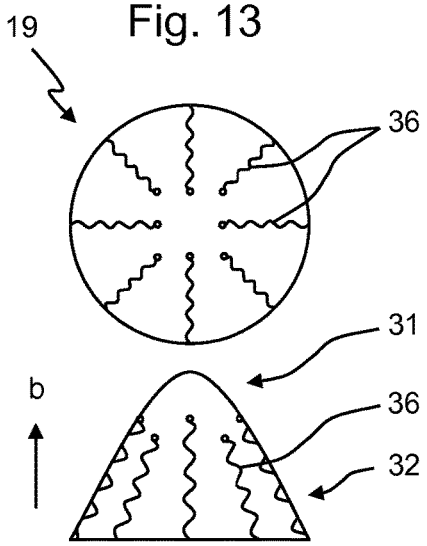
FIG. 13 shows a side view and a front view of a wear protection cap comprising wavy profiling.
Figure 14:
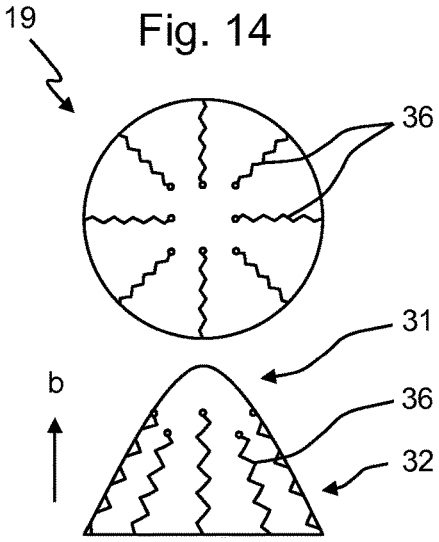
FIG. 14 shows a side view and a front view of a wear protection cap comprising jagged profiling.

The method of manufacture in the form of a single-piece component having predetermined breaking points can also be applied in the case of the multi-piece embodiment of the wear protection cap 19 shown in FIG. 11. In this case the wear protection cap 19 consists of four wear protection rings 23, 24, 25, 26 although this number can again be lower or higher. Unlike the embodiment shown in FIG. 10, the wear protection rings 23, 24, 25, 26 are, however, not set at such a distance from one another that regions of the head 18 of the milling chisel 11 are formed therebetween that are not concealed from the outside by the wear protection cap 19. Instead, virtually the entire tool region P is again concealed by the wear protection cap 19, similar to the single-piece embodiment of FIG. 8. The wear protection rings 24, 25, 26 are made such that they have an overlap edge 27 overlapped by the wear protection ring 23, 24, 25 respectively situated further towards the front as regarded in the direction of advance b of the tool. In other words, the overlap edge 27 of a wear protection ring 24, 25, 26 always lies below a wear protection ring 23, 24, 25 situated further towards the front as regarded in the direction of advance b of the tool. Such overlapping ensures that during operation the head 18 of the milling chisel 11 is always superficially concealed from the environment by the wear protection cap 19 across the entire extent thereof. For the purpose of reinforcing this effect, the wear protection rings 23, 24, 25, 26 interlock, for example, positively. As described above in relation to the embodiment shown in FIG. 10, the wear protection ring 23 is fixed to the head 18 of the milling chisel 11 whilst the wear protection rings 24, 25, 26 can be either attached or laid loosely on top.

Figure 15:
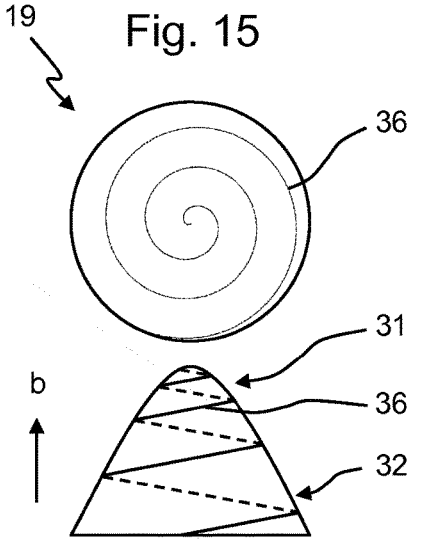
FIG. 15 shows a side view and a front view of a wear protection cap comprising spiral profiling.
Figure 16:
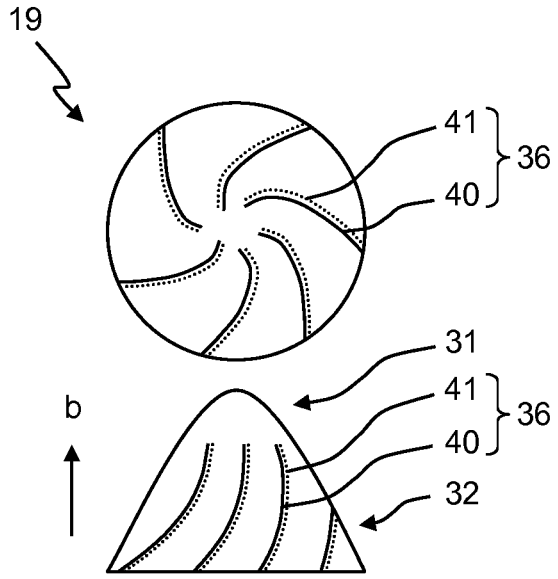
FIG. 16 shows a side view and a front view of a wear protection cap comprising profiling formed by slots and elevated regions.
Figure 17:
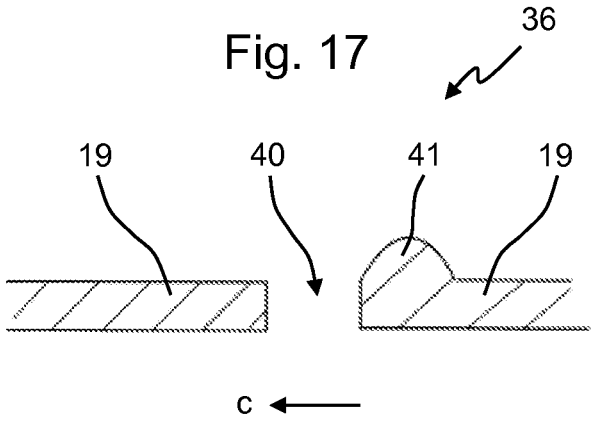
FIG. 17 shows a cross-sectional detailed view of the protective jacket of the wear protection cap with profiling formed by slots and elevated regions shown in FIG. 16.

FIGS. 12, 13, 14, 15 and 16 show wear protection caps 19 provided with profiling 36. In the examples shown, the profiling 36 is in the form of slotted recesses, the example shown in FIG. 16 comprising a profiling formed by slots 40 and elevated regions 41. The patterns 36 can be linear (FIG. 12), wavy (FIG. 13), zig-zag (FIG. 14), or spiral (FIG. 15, at least partially also in FIG. 16). Such patterns serve to guide the milled material along the wear protection cap 19 and help maintain a relief structure, by means of which, for example, a flexible conduct of the wear protection cap can be preserved to the desired extent. Due to the passage of the milled material thereover, the patterns can further serve to convey a drive torque to the milling chisel 11 to cause it to rotate about its symmetry axis 20 during operation. Such rotation can result in the milling chisel 11 being worn evenly on all sides such that its maximum lifespan can be fully exploited. This effect is particularly strong in the exemplary embodiment shown in FIG. 16. The profiling 36 shown in FIG. 16 is further illustrated by the cross-sectional view in FIG. 17. The elevated region 41 provides for particularly efficient guidance of the milled material along the protective jacket 32 in a predetermined direction. Due to the elevated region 41, the milled material is dispatched in the direction of arrow c essentially transversely to the direction of advance b of the tool. As a result of the slightly spiral-shaped progression of the profiling 36 comprising slots 40 and elevated regions 41, the rotation of the milling chisel is supported in a particularly efficient manner. The slots 40 are located behind the elevated regions 41 as regarded in the direction of arrow c. The slots 40 and the elevated regions 41 run parallel to each other and are of essentially equal length. In particular, an elevated region 41 will be adjoining the slots 40 over their entire length. The milled material is guided along the elevated regions 41 away from the wear protection cap 19, and, in particular, the slots 40, which also results in reduced wear of the slots 40.

The wear protection caps 19 can be fixed to the head of the basic body, for example, by way of braze welding, welding, or gluing.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A chisel device for a ground milling machine, comprising:

a chisel holder having a mounting orifice; and a milling chisel having a basic body of a uniform material and including a shaft and a tool region (P), which shaft is under working conditions held in said mounting orifice while said tool region (P) protrudes under working conditions from said chisel holder, wherein said milling chisel has a wear protection cap comprising carbide, said wear protection cap comprising a single piece and having a tip forming a foremost point of said milling chisel and a protective jacket, said wear protection cap being formed in such a manner that said wear protection cap covers at least 70% of the external surface of said tool region (P) of said basic body, wherein said wear protection cap has a profile on its outer surface comprising a plurality of slots which extend in an at least partially spiral pattern from said tip of said wear protection cap to a peripheral region of said protective jacket facing away from said tip, each of said plurality of slots extending entirely through a thickness of said wear protection cap, and wherein an elevated region is arranged in direct adjacency of each of said slots.

2. The chisel device according to claim 1, wherein said wear protection cap of said milling chisel is positioned on said tool region (P) of said basic body in such a manner that said wear protection cap covers the external surface of said tool region (P) of said basic body to an extent of at least 80%.

3. The chisel device according to claim 1, wherein said milling chisel includes a contact ledge for the purpose of said milling chisel making contact with said chisel holder, and said wear protection cap of said milling chisel terminates by way of a collar in a direction of advance (b) of the tool in advance of said contact ledge or flush therewith.

4. The chisel device according to claim 1, wherein said wear protection cap of said milling chisel is provided with a greater wall thickness (h) in regions exposed to stronger stress under working conditions than in regions that are exposed to weaker stress under working conditions.

5. The chisel device according to claim 1, wherein said wear protection cap of said milling chisel includes the tip having a greater wall thickness (h) than said protective jacket.

6. The chisel device according to claim 1, wherein said wear protection cap of said milling chisel comprises a plurality of jacket layers.

7. A milling chisel for a chisel device according to claim 1.

8. The chisel device according to claim 1, wherein said wear protection cap of said milling chisel is positioned on said tool region (P) of said basic body in such a manner that said wear protection cap covers the external surface of said tool region (P) of said basic body to an extent of at least 90%.

9. The chisel device according to claim 1, wherein said wear protection cap of said milling chisel is positioned on said tool region (P) of said basic body in such a manner that said wear protection cap covers the external surface of said tool region (P) of said basic body to an extent of substantially completely.

* * * * *